US005727800A

United States Patent [19]

Liu

[11] Patent Number: 5,727,800

[45] Date of Patent: Mar. 17, 1998

[54] BABY-WALKER WITH AN EXTENSION STAND

[76] Inventor: Yu-Mean Liu, 2F., No. 34, Lane 200, Tung Hwa Street., Taipei, Taiwan

[21] Appl. No.: 670,654

[22] Filed: Jun. 26, 1996

[51] Int. Cl.[6] ..... B62B 9/08

[52] U.S. Cl. ..... 280/87.051; 188/5

[58] Field of Search ..... 188/5; 280/87.051

[56] References Cited

U.S. PATENT DOCUMENTS

| | | | |
|---|---|---|---|
| 2,625,989 | 1/1953 | Pond et al. | 188/5 |
| 2,922,494 | 1/1960 | Clark | 188/5 |
| 2,964,327 | 12/1960 | Mohr | 188/5 |
| 5,366,231 | 11/1994 | Hung | 280/87.051 |
| 5,586,622 | 12/1996 | Hu | 188/5 |
| 5,590,892 | 1/1997 | Hu | 280/87.051 |

*Primary Examiner*—Thomas J. Brahan
*Attorney, Agent, or Firm*—Varndell Legal Group

[57] ABSTRACT

A baby-walker including a top table, an annular base frame having a plurality of downwardly disposed bottom coupling holes around the border, a plurality of wheel assemblies and an extension stand respectively coupled to the downward coupling holes of the base frame by a respective anchoring socket and a respective bolt, and a linkage coupled between the top table and the base frame, the extension stand being moved between the operative position in which the baby-walker is supported on the ground by the extension stand and allowed to be turned about the extension stand, and the wheel assemblies are suspending above the lowest end of said extension stand, and the non-operative position in which the baby-walker is supported on the ground by the wheel assemblies and the extension stand is suspending from the base frame above the elevation of the wheel assemblies.

1 Claim, 8 Drawing Sheets

BABY-WALKER WITH AN EXTENSION STAND

BACKGROUND AND SUMMARY OF THE INVENTION

The present invention relates to a baby-walker, and relates more particularly to such a baby-walker which has an extension stand that can be set between the operative position to hold the baby-walker on the ground in place, and the non-operative position for permitting the wheels of the baby-walker to be moved on the ground from place to place.

Various baby-walkers have been disclosed for supporting a baby learning to walk. When a baby is put in a baby-walker, there must be a person nearby to take care of the baby and to watch the walking of the baby. If the mother or the person who takes care of the baby is absent, the baby-walker must be stopped in place. FIGS. 1 and 2 show a baby-walker which has legs pivoted to the base frame. When the legs are extended out, the baby-walker can be firmly supported on the ground. However, this structure of baby-walker still has drawbacks. One drawback of this structure of baby-walker is the complicated installation process of the legs. Another drawback is that this structure of baby-walker is that the baby will become annoyed and impatient when the baby-walker is stopped in place by the legs.

It is one object of the present invention to provide an extension stand for baby-walker which can be conveniently fastened to the base frame of any of a variety of conventional baby-walkers, and set between the operative position to support the baby-walker on the ground and the non-operative position to let the baby-walker be moved on the ground. It is another object of the present invention to provide a baby-walker with an extension stand which is easy to assemble. It is still another object of the present invention to provide an extension stand for baby-walker which permits the baby-walker to be turned about the extension stand when the extension stand is fastened to the ground. According to one aspect of the present invention, the baby-walker comprises a top table, an annular base frame having a plurality of downwardly disposed bottom coupling holes around the border, a plurality of wheel assemblies and an extension stand respectively coupled to the downward coupling holes of the base frame by a respective anchoring socket and a respective bolt, and a linkage coupled between the top table and the base frame, the extension stand being moved between the operative position in which the baby-walker is supported on the ground by the extension stand and allowed to be turned about the extension stand, and the wheel assemblies are suspending above the lowest end of said extension stand, and the non-operative position in which the baby-walker is supported on the ground by the wheel assemblies and the extension stand is suspending from the base frame above the elevation of the wheel assemblies. According to another aspect of the present invention, the extension stand is comprised of a base member, a vacuum mount fastened to the base member at the bottom, a cap member coupled between the base member and the base frame of the baby-walker and turned around a bolt in an anchoring socket in one downward coupling hole of the base frame of the baby-walker, and a compression spring retained between the cap member and the base member. The base member has longitudinal locating grooves and transverse guide groove respectively connected at right angles. The cap member has coupling blocks raised from a downward coupling barrel thereof, and alternatively set in the longitudinal locating grooves and the transverse guide grooves to hold the extension stand in the operative position or the non-operative position.

DETAILED DESCRIPTION OF THE PREFERRED EMBODIMENT

Figure 1:
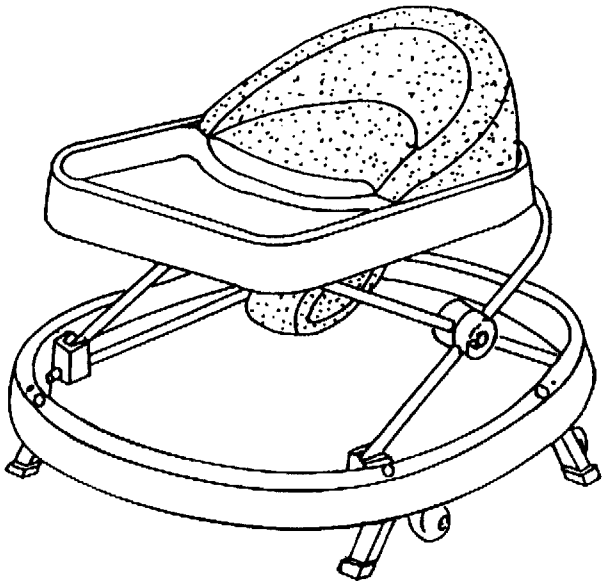
Fig. 1 PRIOR ART
FIG. 1 is an elevational view of a baby-walker according to the prior art.
Figure 2:
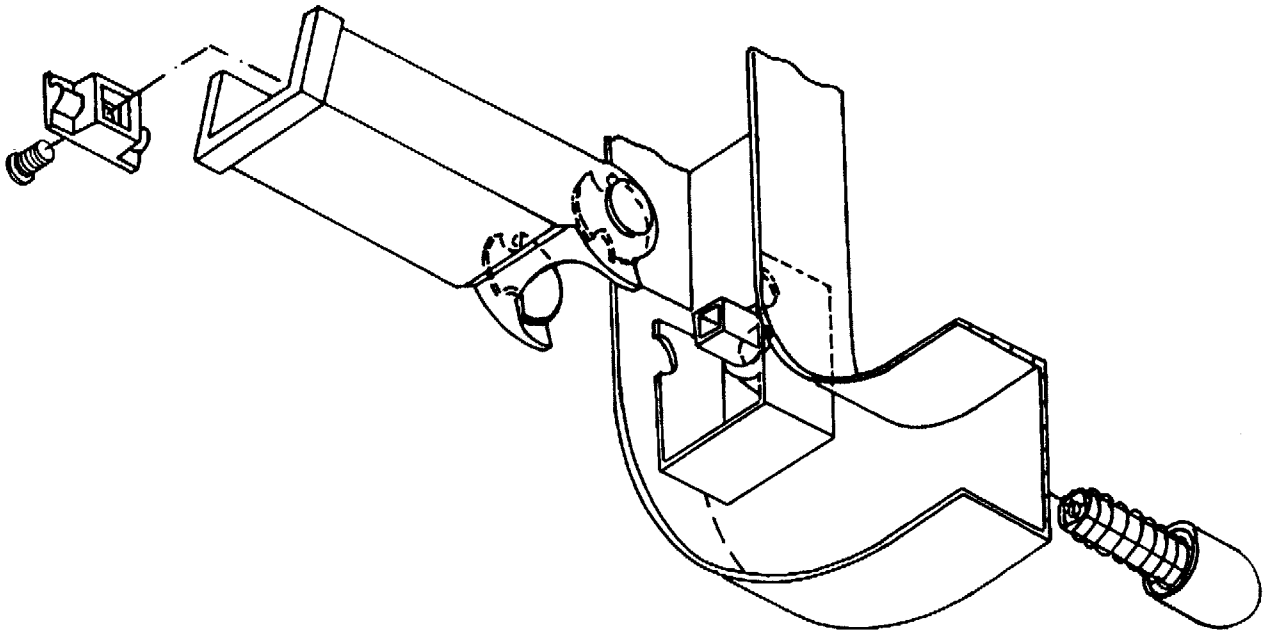
Fig. 2 PRIOR ART
FIG. 2 is an exploded view of a part of the baby-walker shown in FIG. 1, showing the relationship between the leg and the base frame.
Figure 3:
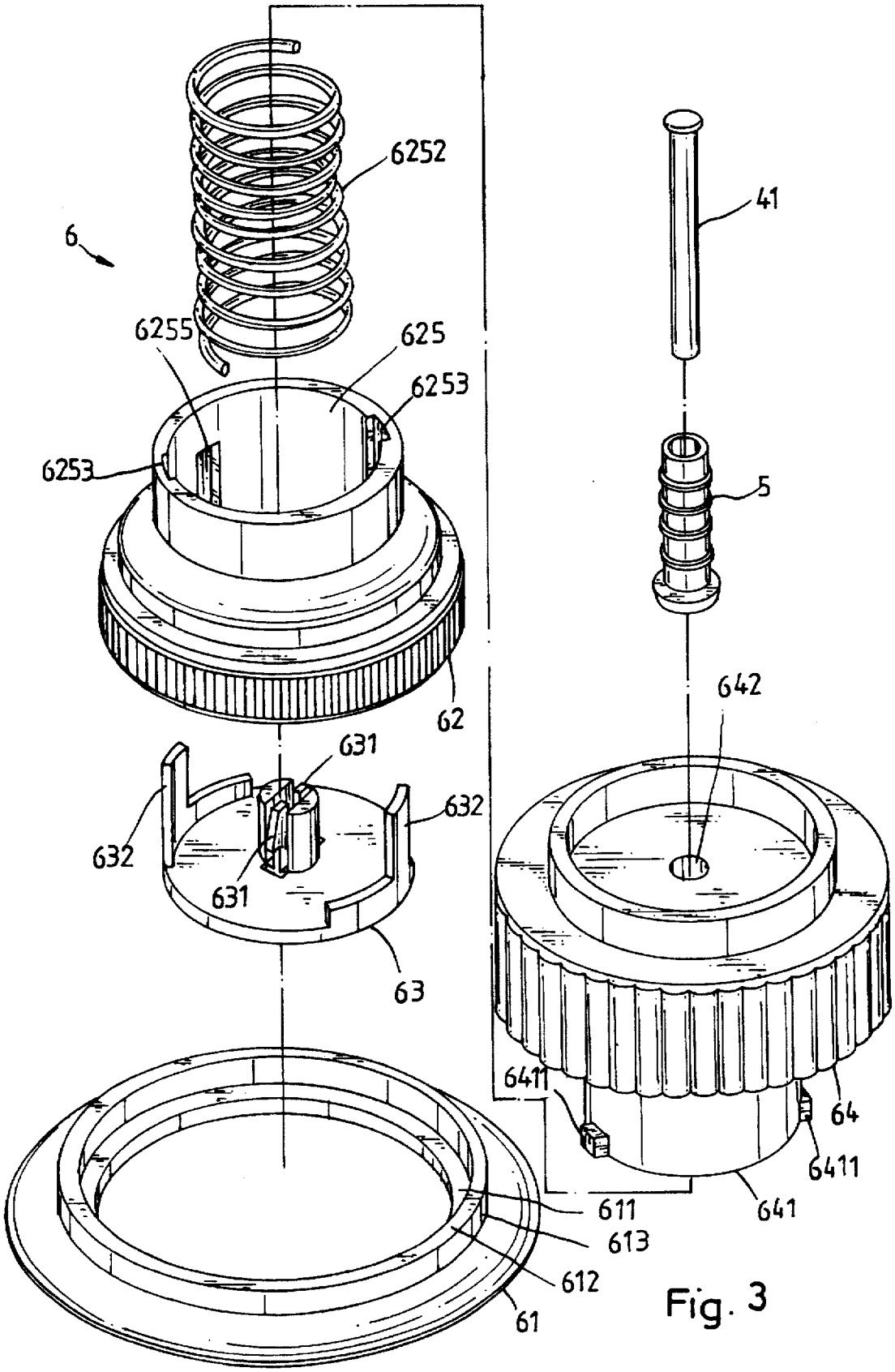
FIG. 3 is an exploded view of an extension stand for a baby-walker according to the present invention.
Figure 4:
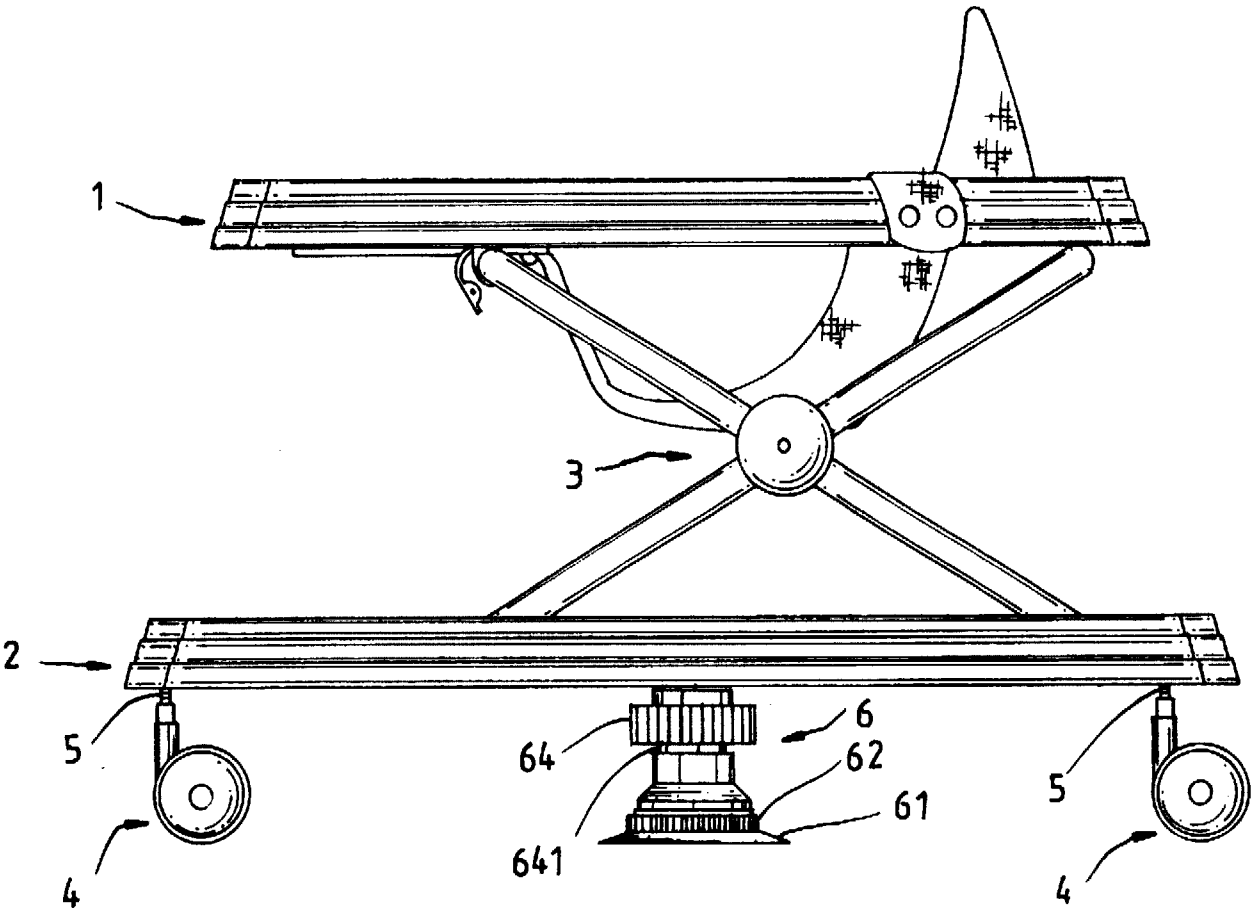
FIG. 4 is a side view of a baby-walker according to the present invention, showing the extension stand set in the working position.
Figure 8:
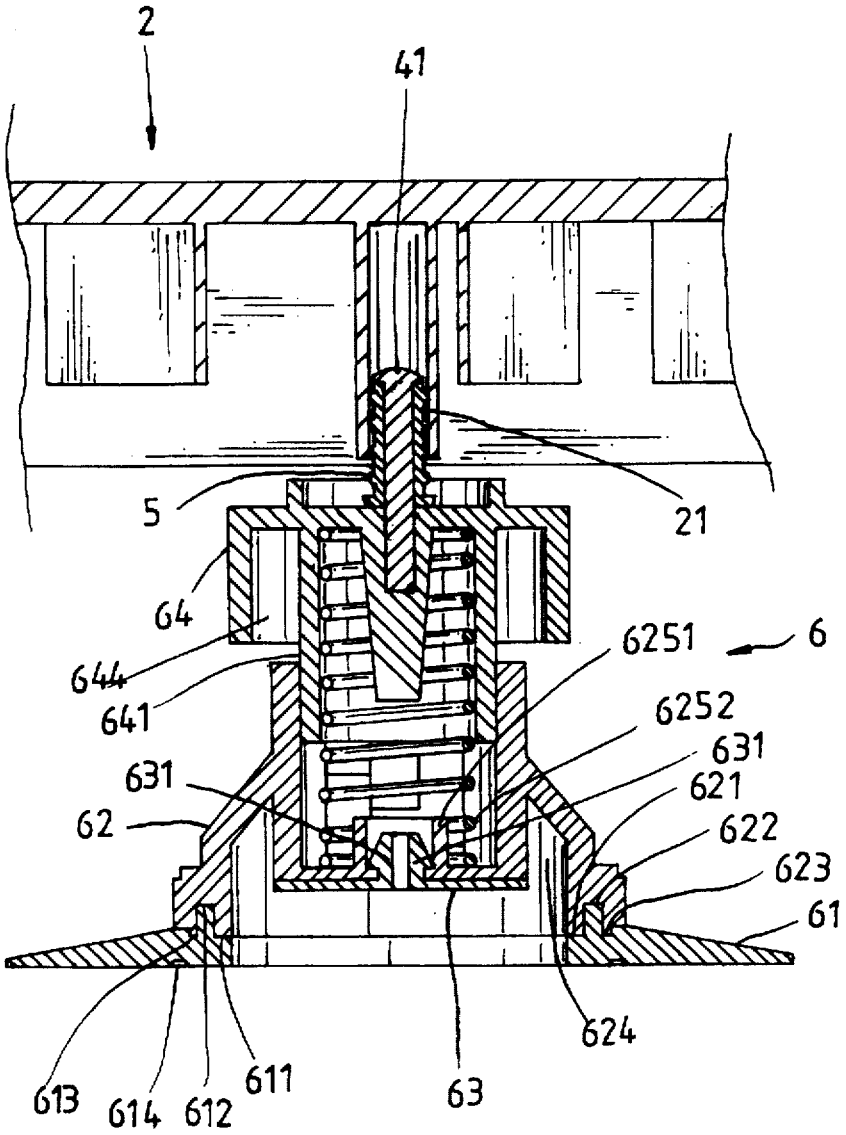
FIG. 8 is a partial view in section in an enlarged scale of a part of FIG. 4, showing the extension stand set coupled to the base frame and set in the working position.

Referring to FIG. 4, a baby-walker in accordance with the present invention is generally comprised of a top table 1 (which has an opening for the passing of the body of the baby), an annular base frame 2 having a plurality of downward coupling holes 21 (see also FIG. 8) at the bottom side around the border, a plurality of wheel assemblies 4 and an extension stand 6 respectively coupled to the downward coupling holes 21 of the base frame 2 by a respective anchoring socket 5 and a respective bolt 41 (see also FIG. 8), and a linkage 3 coupled between the top table 1 and the base frame 2.

Referring to FIGS. 3, 6, 7, and 8, and FIG. 4 again, the extension stand 6 is comprised of an annular vacuum mount 61, a base member 52, a locating member 63, a cap member 64, and a compression spring 6252. The annular vacuum mount 61 comprises a circular center opening 611, an upright annular flange 612 raised from the top around the circular center opening 611, a top annular groove 613 surrounding the upright annular flange 612, and a bottom annular groove 614 at the bottom side adapted for producing a vaccum when the vaccum mount 61 is attached to a flat surface and downwardly compressed. The base member 62 comprises a first chamber 624 having an open bottom adapted for working with the vacuum mount to produce a vacuum, a first downward annular flange 621 surrounding the first chamber 624, a second downward annular flange 623 surrounding the first downward annular flange 621 adapted for engaging the annular groove 613 of the vacuum mount 61, a bottom annular groove 622 defined between the first downward annular flange 621 and the second downward annular flange 623 and adapted for coupling the upright annular flange 612 of the vacuum mount 61, a circular second chamber 625 having an open top, with the center adapted for receiving the compression spring 6252, a center stub tube 6251 at the center of the second chamber 625, two open-ended, longitudinal guide grooves 6253 and two close-ended longitudinal locating grooves 6255 equally spaced within the top open chamber 625, two transverse guide grooves 6254 disposed within the second chamber 625 at two opposite sides and connected between the longitudinal guide grooves 6253 and the longitudinal locating grooves 6255, and two locating blocks 6256 respectively disposed in the transverse guide grooves 6254. Each of the transverse guide grooves 6254 has one end connected to the bottom end of one longitudinal locating groove 6255 at right angles, and an opposite end perpendicularly connected to one longitudinal guide groove 6253. Each of the longitudinal guide grooves 6253 has two opposite open ends respectively extending to the two opposite ends of the second chamber 625. The locating member 63 comprises a split coupling rod 631 raised from the center and adapted for coupling to the center stub tube 6251 of the circular second chamber 625 of the base member 62 from the bottom, and two upright tongues 632 adapted for inserting into the longitudinal guide grooves 6253 of the second chamber 625 of the base member 62. The cap member 64 comprises a center mounting holes 642 adapted for connecting to one downward mounting holes 21 of the base frame 2 by one bolt 41 and one anchoring socket 5, a downward coupling barrel 641 on the inside at the center adapted for coupling to the second chamber 625 of the base member 62 to hold the compression spring 6252 on the inside, an annular groove 644 at the bottom around the downward coupling barrel 641, two coupling blocks 6411 bilaterally raised from the periphery of the downward coupling barrel 641 and adapted for inserting into the longitudinal guide grooves 6253 of the second chamber 625 of the base member 62. During the assembly process, the vacuum mount 61 is fastened to the base member 62 by fitting the upright annular flange 612 of the vacuum mount 61 into the bottom annular groove 622 of the base member 62, then the cap member 64 is fastened to the base member 62 to hold the compression spring 6252 in the second chamber 625 of the base member 62 by inserting the coupling blocks 6411 of the downward coupling barrel 641 into the longitudinal guide grooves 6253 and then turning the cap member 64 relative to the base member 62 to move the coupling blocks 6411 from the longitudinal guide grooves 6253 through the transverse guide grooves 6254 into the longitudinal locating grooves 6255, and then the locating member 63 is fastened to the base member 62 by fitting the split coupling rod 631 of the locating member 63 into the center stub tube 6251 of the circular second chamber 625 of the base member 62 from the bottom and inserting the two upright tongues 632 of the locating member 63 into the longitudinal guide grooves 6253 of the second chamber 625 of the base member 62, and then the center mounting holes 642 of the cap member 64 is fastened to one downward coupling hole 21 of the base frame 2 by one anchoring socket 5 and one bolt 41. When installed, the longitudinal guide grooves 6253 of the base member 62 are locked up by the upright tongues 632 of the locating member 63, and therefore the coupling blocks 6411 of the downward coupling barrel 641 are prohibited from being moved from the transverse guide grooves 6254 into the longitudinal guide grooves 6253.

Referring to FIGS. 4, 6, and 8 again, when the base member 62 is turned relative to the cap member 62 to align the longitudinal locating grooves 6255 with the coupling blocks 6411 of the cap member 64 and then released from the hand, the spring force of the compression spring 6252 forces the base member 62 be respectively engaged with the top ends of the longitudinal locating grooves 6255, and therefore the vacuum mount 61 is moved downwards to a lower elevation than the wheel assemblies 4 and closely attached to the ground. When the vacuum mount 61 is attached to the ground, the baby-walker can be turned about the extension stand 6 (because the bolt 41 which is fastened to the cap member 64 can be turned in the corresponding anchoring socket 5), however the baby can not move the baby-walker out of place.

Figure 5:
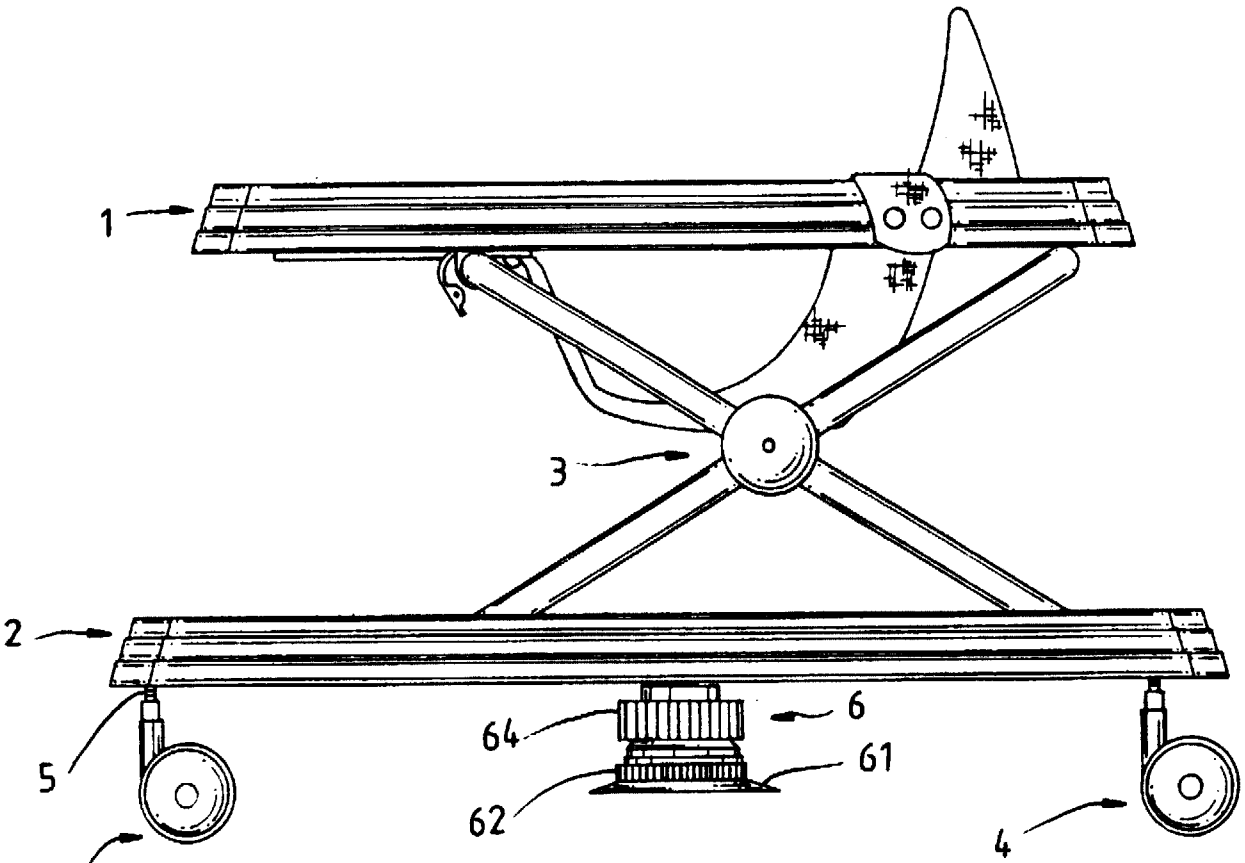
FIG. 5 is another side view of the baby-walker of the present invention, showing the extension stand set in the non-working position suspending above the ground.
Figure 6:
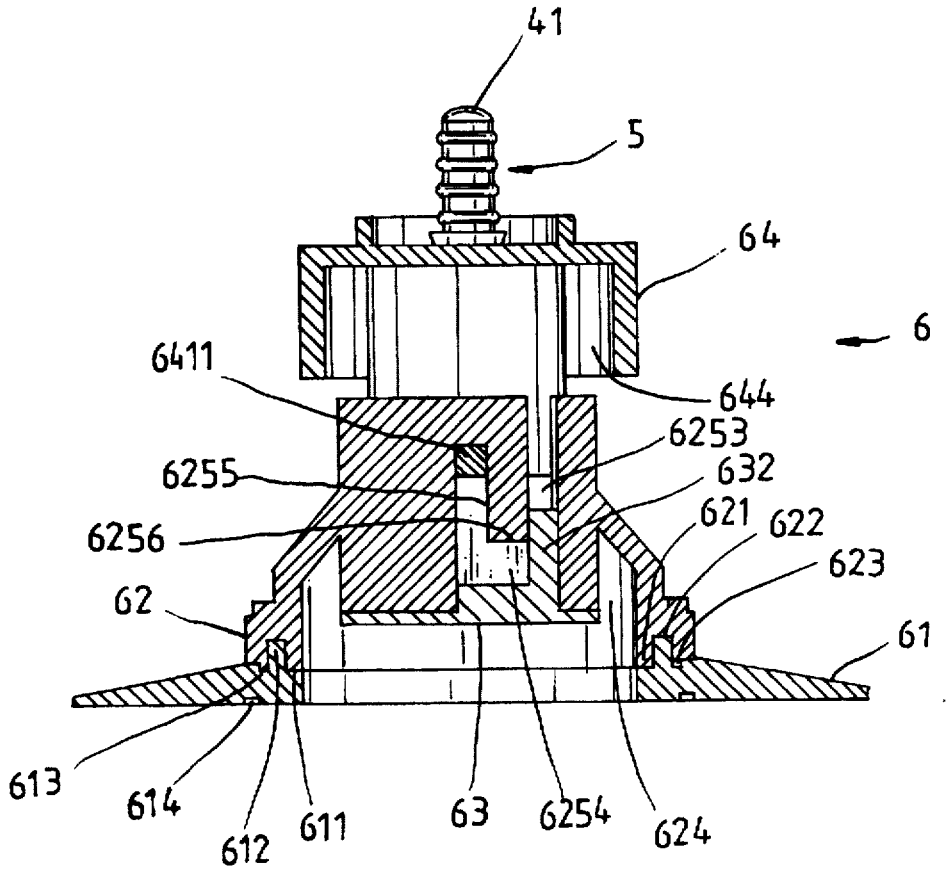
FIG. 6 is a sectional view of the extension stand shown in FIG. 3 when set in the working position.
Figure 7:
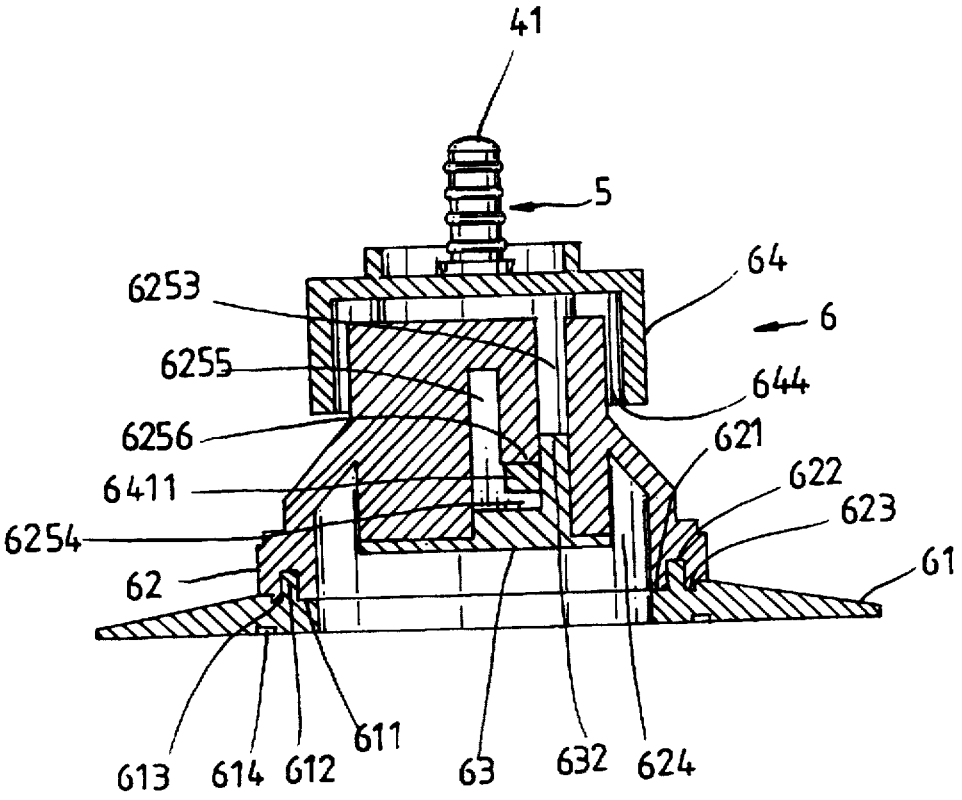
FIG. 7 is another sectional view of the extension stand shown in FIG. 3 when set in the non-working position.

Referring to FIGS. 5 and 7, when the base member 62 is pushed upwards to compress the compression spring 6252 and turned relative to the cap member 64 to force the coupling blocks 6411 of the cap member 64 into the transverse guide grooves 6254 and then into engagement with the locating blocks 6256, the extension stand 6 is held in the non-operative position above the elevation of the wheel assemblies 4, and therefore the baby-walker can be moved by the baby on the ground from place to place.

I claim:

1. A baby-walker comprising a top table, an annular base frame having a plurality of downwardly disposed bottom coupling holes around a border, a plurality of wheel assemblies and an extension stand respectively coupled to said downward coupling holes of said base frame by a respective anchoring socket and a respective bolt, and a linkage coupled between said top table and said base frame, said extension stand being moved between the operative position in which the baby-walker is supported on the ground by said extension stand and said wheel assemblies are suspending above the lowest end of said extension stand, and the non-operative position in which the baby-walker is supported on the ground by said wheel assemblies and said extension stand is suspending from said base frame above the elevation of said wheel assemblies, wherein said extension stand comprises:

a base member, said base member comprising a first chamber having an open bottom, a first downward annular flange surrounding said first chamber, a second downward annular flange surrounding said first downward annular flange, a bottom annular groove defined between said first downward annular flange and said second downward annular flange, a second chamber having an open top, a center stub tube at the center of said top open chamber, two open-ended, longitudinal guide grooves and two close-ended longitudinal locating grooves equally spaced within said second chamber, two transverse guide grooves disposed within said second chamber at two opposite sides and connected between said longitudinal guide grooves and said longitudinal locating grooves, and two locating blocks respectively disposed in said transverse guide grooves, each of said longitudinal locating grooves having a closed top end and a closed bottom end, each of said transverse guide grooves having one end connected to the closed bottom end of one longitudinal locating groove at right angles, and an opposite end perpendicularly connected to one longitudinal guide groove, each of said longitudinal guide grooves having two oposite open ends respectively extending to two opposite ends of said second chamber;

a compression spring mounted in the second top open chamber of said base member;

an annular vacuum mount coupled to said base member and adapted for securing to the ground to hold the baby-walker in place, said annular vacuum mount comprising a circular center opening, an upright annular flange raised from a top side thereof around said circular center opening and fitted into the bottom annular groove of said base member, a top annular groove surrounding said upright annular flange and coupled to the second downward annular flange of said base member;

a cap member fastened to said base member, said cap member comprising a center mounting hole fastened to one downward mounting hole of the base frame of the baby-walker by one bolt and one anchoring socket, a downward coupling barrel on the inside at the center adapted and coupled to the second chamber of said base member to hold said compression spring on the inside, an annular groove at a bottom side thereof around said downward coupling barrel, two coupling blocks bilaterally raised from the periphery of said downward coupling barrel and inserted through the longitudinal guide grooves of the second chamber of said base member and moved between the longitudinal locating grooves of the second chamber of said base member and the transverse guide grooves thereof, the coupling blocks of said downward coupling barrel being respectively engaged with the closed top ends of the longitudinal locating grooves of said base member when the extension stand is moved to said non-operative position by pushing said base member upwards relative to said cap member to compress said compression spring and then turning said base member in one direction relative to said cap member to align the longitudinal locating grooves of said base member with the coupling blocks of said downward coupling barrel, the coupling blocks of said downward coupling barrel being respectively engaged with the locating blocks of said base member when the extension stand is moved to said operative position by pushing said base member upwards relative to said cap member to compress said compression spring and then turning said base member in the reversed direction relative to said cap member to force the coupling blocks of said downward coupling barrel into the transverse guide grooves of said base member; and a locating member fastened to said base member to block up said longitudinal guide grooves, said locating member comprising a split coupling rod raised from the center and coupled to the center stub tube of the second chamber of said base member, and two upright tongues respectively inserted into the longitudinal guide grooves of the second chamber of said base member.

* * * * *